US005400708A

United States Patent [19]

Meschenmoser

[11] Patent Number: 5,400,708

[45] Date of Patent: Mar. 28, 1995

[54] SUPPORTING CONNECTIONS BETWEEN TWO ROLLS

[75] Inventor: Andreas Meschenmoser, Horgenzell, Germany

[73] Assignee: Sulzer-Escher Wyss GmbH, Ravensburg, Germany

[21] Appl. No.: 8,454

[22] Filed: Jan. 25, 1993

[30] Foreign Application Priority Data

Jan. 28, 1992 [DE] Germany ..... 43 02 221.5
Jun. 13, 1992 [DE] Germany ..... 42 19 504.7

[51] Int. Cl.[6] ..... B30B 3/04; D21G 1/00

[52] U.S. Cl. ..... 100/168; 72/237; 72/245; 100/153; 100/162 B; 100/176; 162/273; 162/358.3

[58] Field of Search ..... 100/153, 176, 168–171, 100/162 B; 72/237, 245; 162/272, 273, 358.3, 358.1; 68/244, 256, 272, 274

[56] References Cited

U.S. PATENT DOCUMENTS

| | | | |
|---|---|---|---|
| 2,157,455 | 5/1939 | Kimmel | 72/245 X |
| 3,171,305 | 3/1965 | Stone | 100/170 X |
| 3,921,514 | 11/1975 | Biondetti | 100/176 X |
| 3,946,587 | 3/1976 | Maltby | 72/237 |
| 4,022,122 | 5/1977 | Moser et al. | 100/176 X |
| 4,272,317 | 6/1981 | Roerig | 100/168 X |
| 4,423,612 | 1/1984 | Uppaluri | 72/237 X |

FOREIGN PATENT DOCUMENTS

| | | | |
|---|---|---|---|
| 0326844B1 | 1/1992 | European Pat. Off. . | |
| 1936769 | 2/1971 | Germany | 72/245 |
| 8232424 U | 10/1985 | Germany . | |
| 935363 | 8/1963 | United Kingdom | 100/171 |
| 2024682 | 1/1980 | United Kingdom | 72/245 |

*Primary Examiner*—Stephen F. Gerrity
*Attorney, Agent, or Firm*—Townsend and Townsend Khourie and Crew

[57] ABSTRACT

A roll assembly comprising a rotatable roll (1 in FIG. 2) and a second roll (2 in FIG. 2) cooperating therewith, in which a pressing element (17) to effect displacement between the rolls along a pressure plane of the roll assembly is located in one of the rolls (1,2) and in which both rolls are supported at either end by respective support members (5,6). Prior to operation of the roll assembly, dumbbell-like shaped connecting parts (7) installed in corresponding cut-outs (9) in the support members (5,6) are tensioned and thereby securely form-locked by actuating the pressing element (17). Locking action is released by subsequent deactivation of the pressing element (17) after which the connecting parts (7) can be withdrawn. Two principal advantages of this arrangement, are the compacter construction, enabled by the fact that the frame no longer bears the pressing forces of the roll assembly, and the ease and speed with which components such as rolls, roll jackets or felt belts can be changed.

23 Claims, 3 Drawing Sheets

SUPPORTING CONNECTIONS BETWEEN TWO ROLLS

The invention relates to supporting connections between two rolls, where the roll jacket of at least one roll is arranged to be rotatable about a fixed carrier and is mounted by means of at least one supporting element and is displaceable along a pressure plane of the roll relative to the carrier.

BACKGROUND OF THE INVENTION

These connections are already known and are used in paired roll arrangements which serve for the manufacture or processing of material webs. With fiber webs in particular, the supporting elements at either end of the carrier of the rolls are connected to each other via U-shaped clamps screwed or otherwise fixed to them. Due to the resulting surface pressure and bending moments these, as well as the supporting elements, need to be correspondingly large and are therefore also heavy. The release of these connections also requires considerable time.

OBJECTS AND SUMMARY OF THE INVENTION

A supporting connection which allows a compact construction as well as a rapid change of the roll, felt, fabric, or other covering between paired rolls connecting means supporting parts which each receive one end of the carrier, are connected together in a form-locked manner by at least one connecting part which extends between the supporting parts parallel to the pressure plane. The connecting part has thicker portions at both ends and which is extractably installed in corresponding cut-outs in the supporting parts.

It is essential that the supporting parts, which respectively receive one end of the carrier, are connected together in a form-locked manner by at least one elongated connecting part which extends along the pressure plane and which possesses thickened portions at both ends. The connecting parts are removably installed in respective cut-outs in the supporting parts. A reliable supporting connection between the two rolls can then achieved, when the roll jacket of at least one roll is displaceable along the pressure plane of the roll relative to the fixed carrier.

The thickened portions of the connecting parts can have, for example; a prismatic, trapezoidal or semi-circular cross-section. It is advantageous when the thickened portions have the cross-sectional form of a semicircle whose straight side faces away from the connecting part. This leads to a simplified construction of the cut-out, which thereby consists solely of a lengthways cut as well as a bore adjoined thereto.

In order to limit the size of the connecting parts, which mainly experience tensile forces, they should extend from the outside of the supporting parts towards the roll, over at least 50% of the thickness of the supporting parts. Furthermore, it is advantageous to employ two or more connecting parts between the supporting parts and to arrange these symmetrically to the pressure plane.

Possibly occurring cross-forces, should be taken up by an appropriate design of the displaceable connecting surfaces of the supporting parts. This is also possible by inserting an intermediate part between the two supporting parts. This has the additional advantage that, the changing of the roll jacket, screen, felt or similar, is enabled or simplified by removal of the intermediate part or parts.

In one embodiment the supporting parts for the lower roll are placed on respective stands of fixed location which simultaneously guide the supporting parts. Release of the supporting connections follows simply from unloading the supporting elements which pressurise the roll jacket of one roll in the direction of the cooperating roll. After this relaxation of the form-locked connection, the connecting parts can be removed without difficulty and lifting of the supporting parts follows using appropriate lifting apparatus.

In the other case, the supporting parts of the upper roll are each carried by a respective stand of fixed location; the supporting parts of the lower roll hang on these via the connecting parts. If a release of the connections is necessary here, this is also achieved by unloading the supporting elements. In this latter case, the lower roll must be subsequently lifted and fixed in its position by appropriate external auxiliary devices to further unload the connection. This arrangement is particularly advantageous when access to the lower roll needs to be improved.

BRIEF DESCRIPTION OF THE DRAWINGS

In the following, the invention is described in more detail with reference to two exemplary embodiments. The enclosed drawings show.

DESCRIPTION OF THE PREFERRED EMBODIMENTS

Figure 1:
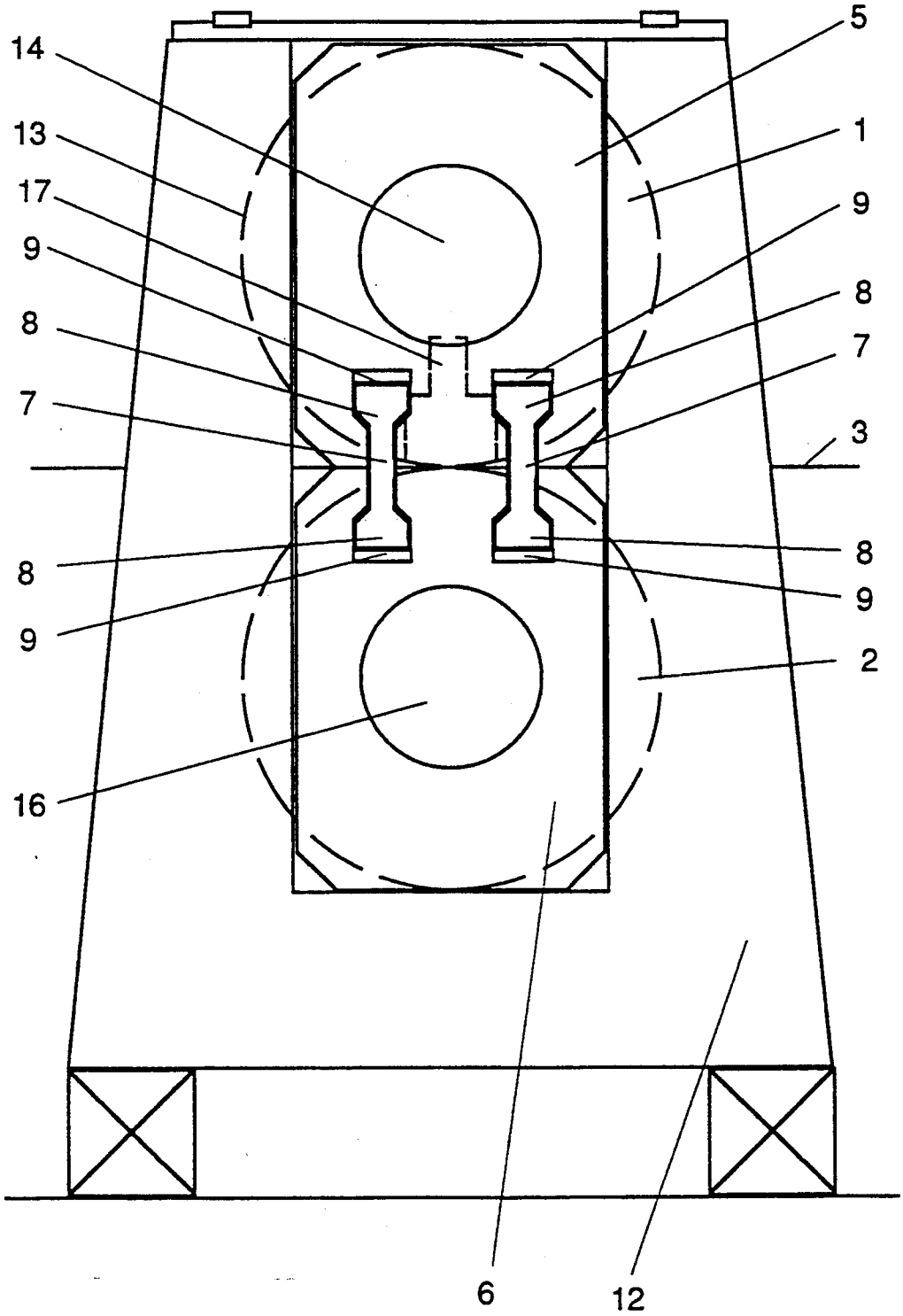
FIG. 1 is a schematic side view of a roll stand with the supporting connections.

In the embodiment shown in FIG. 1, two rolls 1,2 form a roll gap for the processing of a material web 3, wherein the roll jacket 13 of the upper roll 1 is arranged to be rotatable about a fixed carrier 14 and is mounted upon it by means of several supporting elements 17 and is displaceable along the pressure plane of the roll 1 relative to the carrier 14. Such supporting elements 17 are known, for instance, from CH-PS 541 088. These roll arrangements are often used for the smoothing of paper webs.

The supporting parts 5 and 6, which respectively receive one end of the carriers 14 and 16, are connected together in a form-locked manner by connecting parts 7 which extend over the full thickness of the supporting parts and which possess thickened portions 8 at both ends and which are extractably installed parallel to the roll axis in corresponding cut-outs 9 of the supporting parts 5,6. The supporting parts 6 for the lower roll 2 lie on respective stands 12 of fixed location which also laterally guide both supporting parts 5,6 thereby taking up forces acting transverse to the pressure plane.

For assembly, the supporting parts 5 and 6 of the rolls 1 and 2 are consequently installed in the stands 12. After the connecting parts 7 have been slid into the cut-outs 9, the fixing of the connection follows by displacing the roll jacket 13 along the pressure plane towards the roll 2 by using the supporting elements 17. The connections are released in the opposite order.

Known safety elements may be provided, to secure the connecting parts 7 at the outside of the supporting parts 5,6 against displacement. Furthermore, it is also possible to utilise the supporting connections for more than two rolls 1,2 placed on one another, wherein however at least one roll jacket 13 of each roll gap forming roll 1,2 needs to be displaceable along the pressure plane in the described manner.

Figure 2:
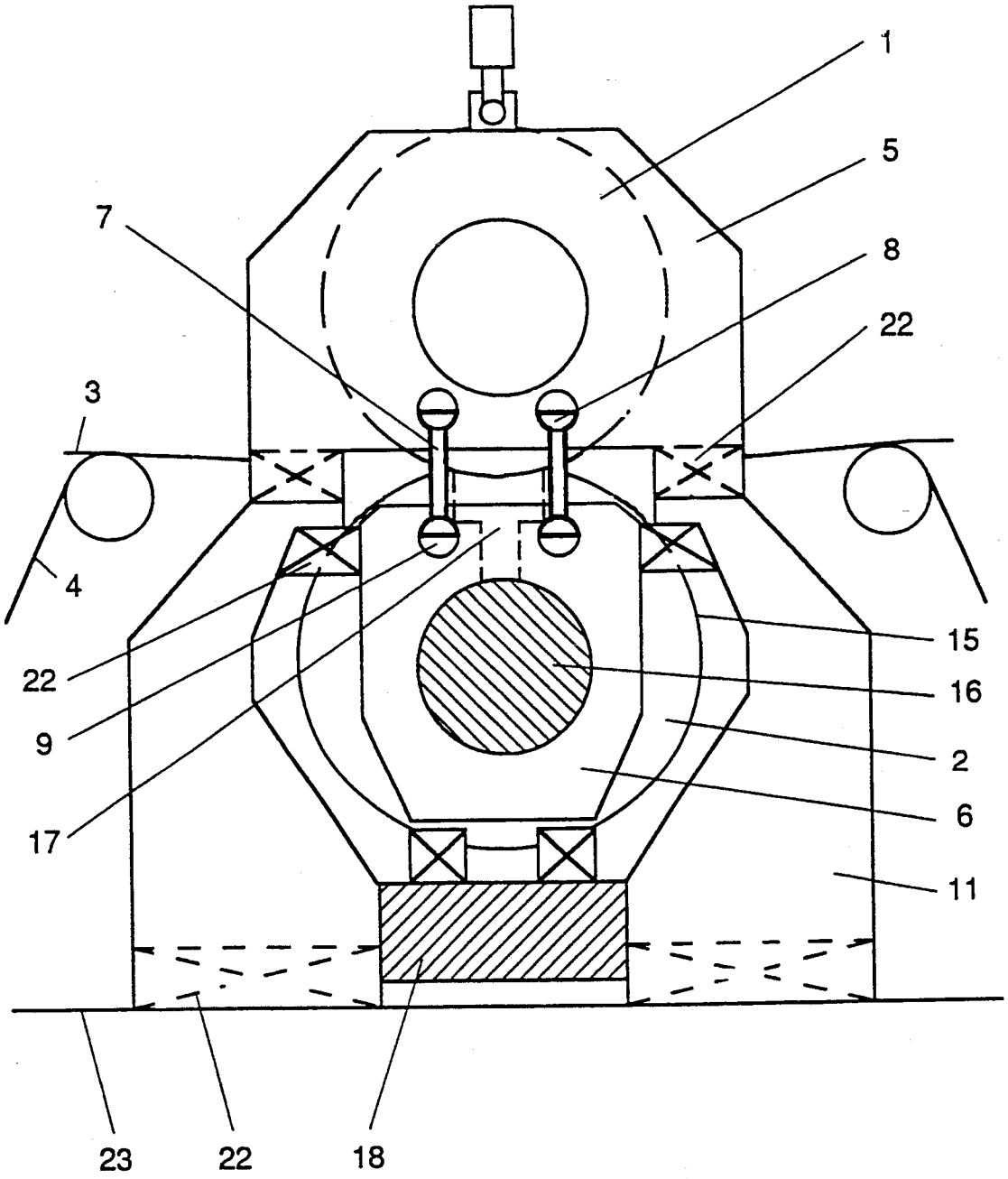
FIG. 2 is a section A—A according to FIG. 3.
Figure 3:
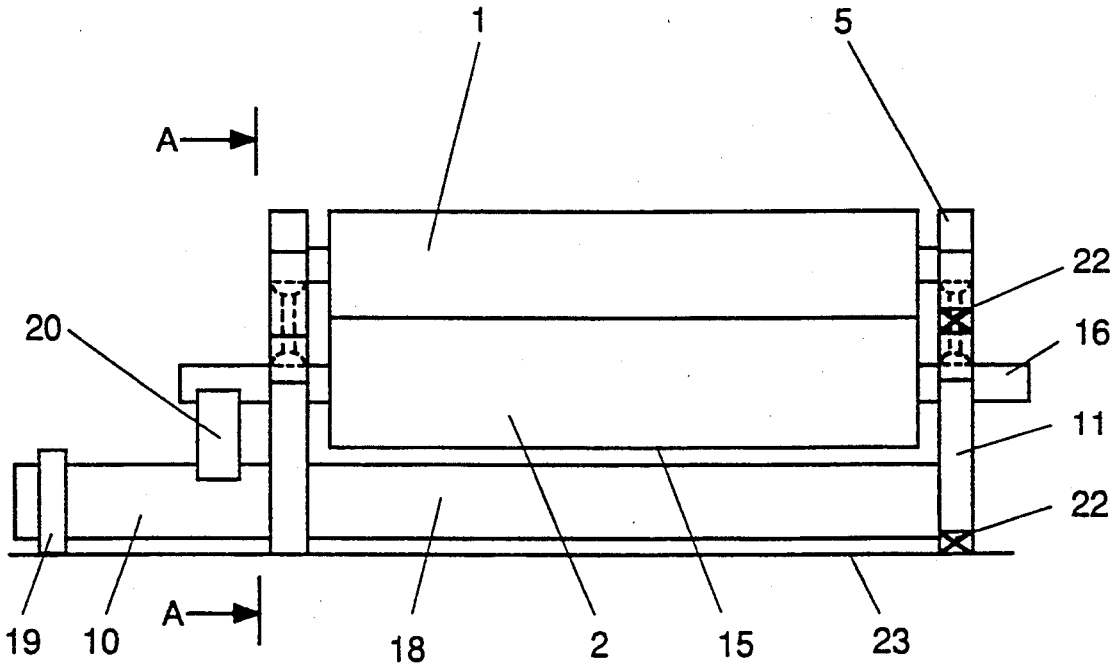
FIG. 3 is a schematic representation of another embodiment.
Figure 4:
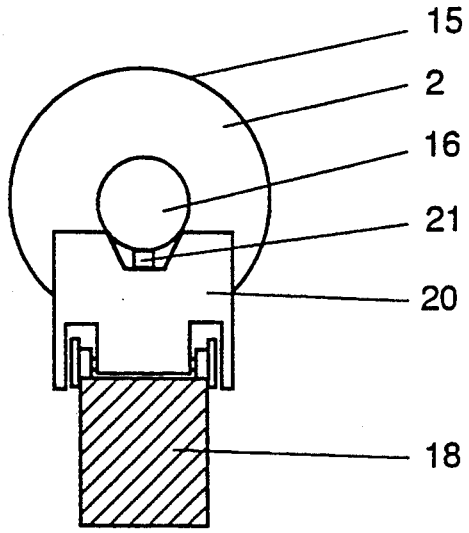
FIG. 4 is a transport device 20 for the roll 2 according to FIG. 3.

FIG. 2 represents another embodiment in which two rolls 1,2 form a roll gap for the processing of a material web 3 and the roll jacket 15 of the lower roll 2 is arranged to be rotatable about a fixed carrier 16 and is mounted upon it by means of several supporting elements 17 and is displaceable along the pressure plane of the roll 2 relative to the carrier 16. Such arrangements are used, for example, for water extraction from fiber webs and are, for example, known from the German patent DE-PS 31 26 492. To take up the fluid, a felt 4 is fed through the roll gap together with the fiber web 3.

Due to wear, it follows that a rapid and simple change of the roll, roll jacket or felt belt is a necessity for these devices. For this reason, a device is proposed, for instance in the German patent DE-PS 31 00 522, in which a removable intermediate part is provided between a cantilever carrier and the supporting frame of the press roll and in which the cantilever carrier has a transport device for installation and removal of the press roll. However, this takes up a lot of space, which has negative consequences when refitting.

The form and arrangement of the connecting parts 7 correspond to those of the first example embodiment, wherein however the thickened portions 8 of the connecting parts 7 have approximately the cross-sectional form of a semi-circle the straight side of which, faces away from the connecting part 7. The cut-outs 9, which are arranged symmetrically about the pressure plane, thus have an elongated form, adjoined in each case by a bore for receiving the thickened portion 8. Furthermore, these supporting parts 5 for the upper roll 1 are each carried in a stand 11 of fixed location. The supporting parts 6 for the roll 2 hang from the supporting parts 5 on the connecting parts 7. To take up possibly occurring transverse forces, an intermediate part 22 is provided in each case between each of the supporting parts 5,6 and the stand 11.

Because the supporting part 5,6 at each end of the carriers 14,16 of the corresponding rolls 1 and 2, which each receive one end of the carrier 14 and 16 respectively, are directly as well as releasably connected with each other, the pressing force of the rolls 1,2 is taken up via the supporting connections and not as is normal by a stand, it is possible to make the entire arrangement lighter and compacter. This in turn means that an additional carrier in the form of a cantilever carrier 18 of small dimensions can be used, which extends between the supporting parts 6 and partly beyond parallel to the carriers 14,16 of the rolls 1,2 and which is guided out of the roll arrangement at one end and is connected there to a fixed component 19. The stands 11 are thereby connected by the cantilever carrier 18.

In order also to make a rapid and simple roll change possible, the cantilever carrier 18 should have a transport device 20 for the installation and removal of the lower roll 2.

Establishing the connections takes place in such a way that the lower roll 2 is held in a given position via its carrier 16 as well as by auxiliary devices attached to it, with the supporting parts 5 of the upper roll 1 being subsequently placed on the stands 11. After having slid the connecting parts 7 into the cut-outs 9, the tensioning of the connections takes place by displacement of the roll jacket 15 along the pressure plane towards the roll 1 by means of the supporting elements 17.

Detachment of the connections can take place after the connections, via the supporting elements 17, have been relaxed and also the carrier 16 and thus the supporting parts 6 have been lifted slightly.

In order to change the lower roll 2, the supporting connections are removed, wherein the lifting of the drive-side end of the lower roll 2 takes place with a cylinder-piston unit 21 of the transport device 20 which can be moved along the cantilever carrier 18. Lifting of the operator-side end of the lower roll as well as the extraction, is realised by a hoisting device acting on the operator-side roll end. During this, the lateral intermediate parts 22 which are located between the lower supporting parts 6 and the stand 11 are naturally removed.

Changing of the lower roll jacket 15 has also as a prerequisite the detachment of the operator-side supporting connections as well as those of the lateral intermediate parts 22 which are located between the stand 11 and the lower supporting part 6. If, as shown in FIG. 2, the lower supporting part 6 is smaller than the roll jacket 15, removal of the same is not necessary. The changing of the roll jacket 15 can now follow using the familiar devices, where during this the operator-side end of the carrier 16 of the lower roll 2 must be held in its position.

When changing the felt belt it is possible, as a result of the cantilever carriers 18 which are connected to the stands 11, to completely pull in the felt belt 4. To do this, it is necessary to lift the stand 11 on the operator-side somewhat; to remove the intermediate parts 22 between the base surface 23 and the stand 11; to lift up the upper operator-side supporting part 5 after having detached the supporting connections; as well as to remove the intermediate parts 22 located between the upper supporting part 5 and the stand 11.

The holding and lifting of the carrier 16 of the lower roll 2, necessary for establishing and releasing the connections, can of course be achieved with auxiliary devices which act upon the supporting parts 6 of the lower roll 2.

Further embodiments of the invention may also be realised in which the hitherto described lower roll 2 is substituted by another type of lower pressing member, for example a non-rotatable pressing member, but with the other hitherto described features of the invention, in particular the connecting means, being retained. For example a so-called extended-nip press can be used, where an upper rotatable roll 1 cooperates with a fixed lower pressing member, as for instance detailed in EP 0 328 844 or in the U.S. patent application of Nov. 26, 1991 entitled "Apparatus for the dewatering of a web of fibrous material", which claims priority from the German application P 41 38 788.0. It is noted that in some embodiments of the latter invention, the pressing element of the lower pressing member is split into several parts along the nip or gap in the axial direction of the roll, rather than being formed as a unitary part which is also possible. In all cases, the lower pressing element is biased upwardly towards the rotatable roll. The use of such forms of lower pressing member does not materially affect the essential features of the invention described here, in particular those pertaining to the connecting means. It is noted that with such arrangements a separate recirculating band is frequently provided which moves over the surfaces of the pressing element between this element and the rotatable roll. Further, the invention also extends to inverted arrangements in which the stationary pressing member is disposed above the rotatable roll. In a similar vein, the stationary pressing member could also be disposed alongside the rotatable roll.

I claim:

1. Connecting means between two rolls contacting one another at a pressure plane between said rolls, said rolls being supported on a stand at either end, said connecting means comprising:

a fixed carrier attached to said stand;

at least one of said rolls having a roll jacket, said roll jacket of said at least one roll arranged to be mounted on and rotatable about said fixed carrier;

at least one supporting element being mounted on said fixed carrier and displaceable with respect to said fixed carrier towards and away from said other of said two rolls, said one supporting element acting against said at least one of said rolls for producing pressure toward the other of said rolls along a pressure plane;

supporting parts at each end of said rolls mounted to said stand;

each supporting part at one end of said at least one of said rolls being received at said stand for connection to a corresponding supporting part received at a corresponding end of the other of said rolls;

at least one connecting part for connecting said corresponding supporting parts;

said at least one connecting part extending between said corresponding supporting parts parallel to said pressure plane between said rolls;

said at least one connecting part comprising thicker portions at distal ends thereof with a thinner portion therebetween;

cut-outs in said corresponding supporting parts, said cut-outs having a dimension to permit installation of said at least one connecting part at said thicker portions in said cut-outs in said supporting parts with said thinner part extending between said corresponding supporting parts; and, said cut-outs of said corresponding supporting parts defining a passage for the removable insertion of said at least one connecting part being carried out in a direction parallel to the roll axis.

2. Connecting means between two rolls contacting one another at a pressure plane between said rolls according to claim 1 and wherein:

at least one connecting part has at least 50% of the thickness of a corresponding supporting part.

3. Connecting means between two rolls contacting one another at a pressure plane between said rolls according to claim 1 and wherein:

said at least one connecting part comprises a plurality of connecting parts between the corresponding supporting parts.

4. Connecting means between two rolls contacting one another at a pressure plane between said rolls according to claim 1 and wherein:

said thicker portions of said at least one connecting part possesses an approximately semi-circular cross-section having a straight side, said straight side facing away from said connecting part; and, said cutouts in said corresponding supporting parts defining a bore for receiving these connecting parts.

5. Connecting means between two rolls contacting one another at a pressure plane between said rolls according to claim 1 and wherein:

an intermediate member is inserted between two said supporting parts to hinder the displacement of the supporting parts transverse to the pressure plane of the rolls.

6. Connecting means between two rolls contacting one another at a pressure plane between said rolls according to claim 1 and wherein:

connecting faces of the supporting parts have a form which prevents displacement of the supporting parts transverse to the pressure plane of the rolls.

7. Connecting means between two rolls contacting one another at a pressure plane between said rolls according to claim 1 and wherein:

one of said rolls is an upper roll; and, said supporting parts of said upper roll are each carried by said stand.

8. Connecting means between two rolls contacting one another at a pressure plane between said rolls according to claim 1 and wherein:

one of said rolls is a lower roll and said supporting parts for said lower one of said two rolls contacting one another each lie on said stand, said stand configured to guide said supporting parts in a lateral direction.

9. Connecting means between two rolls contacting one another at a pressure plane between said rolls according to claim 1 and further comprising:

at least one cantilever carrier, said at least one cantilever carrier extending between said supporting parts and partly beyond one of said supporting parts parallel to the rolls;

means connecting said at least one cantilever carrier to stand.

10. Connecting means between two rolls contacting one another at a pressure plane between said rolls according to claim 9 and wherein:

one of said rolls is a lower roll and said cantilever carrier has a transport device for the installation and removal of the lower roll.

11. A roll assembly comprising:

at least one rotatable roll;

a pressing member cooperating with said at least one rotatable roll to define a press gap between said at least one rotatable roll and said pressing member;

said at least one rotatable roll comprising a roll carrier extending substantially axially through a roll jacket and having first and second axial ends;

first support members provided one at each of said axial ends of said roll carrier;

means for urging said roll jacket towards said pressing member to generate during rotation of said at least one rotatable roll a desired pressure distribution in said defined press gap, said means for urging including means for deactivation of said means for urging said roll jacket towards said pressing member;

said pressing member cooperating with said at least one rotatable roll and having first and second axial ends;

second support members provided one at each of said axial ends of said pressing member;

at least one connecting part provided between each of said first support members and said second support members and connecting the associated first and second support members together;

said at least one connecting part being secured in position under the action of said means for urging; and, said at least one connecting part being removable when said means for urging said roll jacket towards said pressing member is deactivated by said means for deactivation.

12. A roll assembly in accordance with claim 11 wherein:

said pressing member comprises a rotatable roll.

13. A roll assembly in accordance with claim 11 wherein;

said at least one connecting part has a dimension in an axial direction of said rotatable roll comprising at least 50% of a thickness dimension of one of the associated first and second supporting members.

14. A roll assembly in accordance with claim 11 wherein:

at least first and second connecting parts are provided between said first and second supports members.

15. A roll assembly in accordance with claim 14 wherein:

said at least first and second connecting parts are substantially symmetrically disposed on opposite sides of a plane extending through an axis of rotation of said rotatable roll and an axis of symmetry of said pressing member.

16. A roll assembly in accordance with claim 11 wherein:

each said at least one connecting part has a dumbbell-like cross-section.

17. A roll assembly in accordance with claim 16 wherein:

each said at least one connecting part of dumbbell-like cross-section has first and second head portions, said first and second head portions being received in respective first and second correspondingly shaped recesses of said first and second support members.

18. A roll assembly in accordance with claim 11 wherein:

an intermediate member is provided between said first and second support members, said intermediate member acting to substantially prevent displacement of said support members transverse to a plane of symmetry, which extends through an axis of rotation of said rotatable roll and an axis of symmetry of said pressing member.

19. A roll assembly in accordance with claim 11 wherein:

said first support members and said second support members have confronting faces configured to prevent displacement of said first and second support members transverse to a plane of symmetry, which extends through an axis of rotation of said rotatable roll and an axis of symmetry of said pressing member.

20. A roll assembly in accordance with claim 11 wherein:

said at least one rotatable roll is disposed above said pressing member; and, a stand;

means for carrying said first supporting members in said stand.

21. A roll assembly in accordance with claim 11 wherein said second support members for said pressing member each lie on a respective stand of fixed location, said stand having wall means for guiding said first and second support members in a lateral direction transverse to said plane of symmetry.

22. A roll assembly in accordance with claim 11 wherein:

said second support members of said pressing member are suspended from said first support members for said at least one rotatable roll through said at least one connecting part; and, means for lifting said second support member provided at at least one end of said pressing member to facilitate removal of said at least one connecting part.

23. A roll assembly in accordance with claim 11 wherein:

each said at least one connecting part has a dimension in the axial direction of said rotatable roll comprising at least 50% of a thickness dimension of one of said first and second supporting parts.

* * * * *